US005425788A

United States Patent [19]

Garapon et al.

[11] Patent Number: 5,425,788

[45] Date of Patent: Jun. 20, 1995

[54] ADDITIVE COMPOSITIONS FOR FUELS COMPRISING NITROGEN-CONTAINING PRODUCTS INCORPORATING TWO IMIDE RINGS AND FUELS CONTAINING THEM

[75] Inventors: Jacques Garapon, Lyon; Alain Forestiere, Vernaison; Philippe Mulard, St. Pierre de Chandieu; Yvan Labruyere, Lyon, all of France

[73] Assignees: Institut Francais du Petrole, Rueil Malmaison; Elf Antar France, Paris La Defense, both of France

[21] Appl. No.: 145,542

[22] Filed: Nov. 4, 1993

[30] Foreign Application Priority Data

Nov. 4, 1992 [FR] France ..... 92 13353

[51] Int. Cl.[6] ..... C10L 1/22; C10L 1/18

[52] U.S. Cl. ..... 44/348; 44/347; 44/432; 44/443; 44/447; 44/459

[58] Field of Search ..... 44/348, 347, 443, 447

[56] References Cited

U.S. PATENT DOCUMENTS

| | | | |
|---|---|---|---|
| 3,658,494 | 4/1972 | Dorer, Jr. | 44/443 |
| 3,733,303 | 5/1973 | Adachi et al. | 260/47 CP |
| 3,901,665 | 8/1975 | Polss | 44/443 |
| 4,548,616 | 10/1985 | Sung et al. | 44/443 |
| 5,006,130 | 4/1991 | Aiello et al. | 44/443 |
| 5,053,056 | 10/1991 | Montagne et al. | 44/447 |
| 5,061,291 | 10/1991 | Sung | 44/347 |
| 5,234,476 | 8/1993 | Garapon et al. | 44/348 |

FOREIGN PATENT DOCUMENTS

| | | |
|---|---|---|
| 0327097 | 8/1989 | European Pat. Off. . |
| 0349369 | 1/1990 | European Pat. Off. . |
| 0526314 | 2/1993 | European Pat. Off. . |
| 0530094 | 3/1993 | European Pat. Off. . |
| 2152271 | 4/1972 | Germany . |

*Primary Examiner*—Ellen M. McAvoy
*Attorney, Agent, or Firm*—Millen, White, Zelano, & Branigan

[57] ABSTRACT

An additive composition for fuels comprising at least one constituent (A) and at least one constituent (B), the said constituent (A) comprising at least one multinitrogen-containing compound of general formula (I):

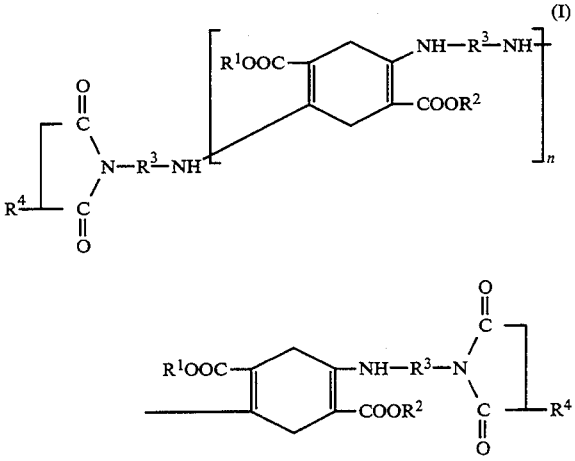

(I)

where $R^1$ and $R^2$, which are the same or different each represent a hydrocarbon group or a group of formula $R^5$—(—O—$R^6$—)$_a$—(—O—$R^7$—)$_b$—, $R^3$ is a hydrocarbon group or a group of formula $R^8$—(—X—$R^9$—)$_c$—(—X—$R^1$O—)$_d$—(—X—$R^{11}$—)$_e$— in which X is selected from the groups —O— and —$NR^{12}$—, $R^5$, $R^6$, $R^7$, $R^8$, $R^9$, $R^{10}$ and $R^{11}$ each represent a hydrocarbon group, a, d and e are each zero or a whole number, b and c are each a whole number, $R^4$ and $R^{12}$ each represent a hydrogen atom or a hydrocarbon group and n is a number from 0 to 20 and the said constituent (B) comprises at least one polyglycol which is soluble in the fuel in question. The additive composition may also contain a detergent-dispersant product. These compositions are useful as multipurpose additives for fuels used in internal combustion engines, in particular in spark ignition engines.

27 Claims, No Drawings

ADDITIVE COMPOSITIONS FOR FUELS COMPRISING NITROGEN-CONTAINING PRODUCTS INCORPORATING TWO IMIDE RINGS AND FUELS CONTAINING THEM

BACKGROUND OF THE INVENTION

This invention relates to additive compositions, in particular for fuels comprising at least one nitrogen-containing product incorporating two terminal imide rings and at least one polyglycol which is soluble in the said fuel, as well as preferably at least one detergent-dispersant. These compositions can be used as multipurpose additives for fuels and in particular for fuels used in spark ignition engines.

The use of conventional fuels very frequently leads to fouling of various parts of the engine as a result of incomplete vaporization and combustion of the fuel in the inlet system and in the combustion chambers.

In particular, in the case of spark ignition engines the formation and accumulation of deposits in the combustion chambers disturbs normal engine operating conditions.

These deposits significantly alter of heat transfer between the combustion chambers and the engine's cooling system by forming a layer of an insulating nature.

This results in an increase in the temperature within the chambers the feed gas mixture enters. Self-ignition of these gases is thus promoted, which gives rise to the appearance of the well-known phenomenon of engine knock.

In addition to this, the accumulation of these deposits in the combustion chambers may result in a reduction c,f the volume of the combustion zone, which is then reflected in an increase in the engine's compression ratio. This also promotes the occurrence of knock. In addition to this, the deposits which form in the various parts of the engine in contact with the fuel can partly absorb some of the fuel, thus contributing to a change in the fuel-oxidant mixture, with a stage of fuel impoverishment during absorption and a stage of fuel enrichment when the fuel is desorbed. Such a fluctuation in the richness of the fuel-air-mixture prevents the engine from operating under optimum conditions.

Whereas, periodic expensive cleaning of the affected parts of the engine, in particular the valves, may be carried out at intervals in order to deal with the fouling, the accumulation of deposits within engines and in particular on inlet valves may also be reduced by using fuels containing certain additives, for example additives of the detergent type which may for example be combined with corrosion prevention additives or additives preventing combustion chamber deposits.

The additives, which are well known in the trade, for example those of the polyisobutene-amine type, are normally associated with a mineral or synthetic oil and can cause increased fouling of combustion chambers and therefore an increase in the engine octane requirement, with a greater sensitivity to knock.

Of the many additives described in the prior art mention may be made of the condensation products of polyalkenylsuccinic anhydrides with polyamines, such as, for example, tetraethylenepentamine, which are in particular described in U.S. Pat. No. 3,172,892. These additives provide satisfactory results from the point of view of corrosion prevention properties, but are not effective as valve detergents.

Mention may also be made of the condensation products of polyalkenylsuccinic anhydrides with hydroxyimidazolines, in particular with 1-(2-hydroxyethyl-)imidazolines substituted by an alkyl or alkenyl group in the 2 position, such as those described in patent application EP-A-74724. The products described in this application are satisfactory additives for engine fuels and have a significant corrosion preventing effect, but are not very effective from the point of view of carburetor detergency.

Combustion chamber fouling occurs progressively with the operation of an engine. An engine is characterised by its octane requirement, which corresponds to the minimum octane number of the fuel required by the engine in order to operate without knock. When the value of the engine's octane requirement exceeds the value of the octane number of the fuel used to operate the engine, in particular as the result of combustion chamber fouling, the phenomenon of knock is observed. The increase in the octane requirement of the engine is conventionally, for those skilled in the art, the phenomenon of ORI, named after the English abbreviation for "Octane Requirement Increase".

In order to restrict the occurrence of knock and its adverse consequences on an engine such as increased fatigue and wear on its vital parts, an excessively high engine octane requirement can be remedied by using a fuel which has a higher octane number than that previously used, subject to availability and a higher cost, The combustion chambers may also be cleaned out at intervals in order to remove the deposits formed and reduce the engine's octane requirement. This operation is however time-consuming and very costly.

Many patent documents describe additives which can be used in particular in engine fuels. Compositions such as those described for example in patent application EP-A-327097 have satisfactory anti-ORI properties, but relatively limited detergent properties. In addition, these compositions are not described as having good corrosion prevention properties.

SUMMARY OF THE INVENTION

Surprisingly, additive compositions such as those described below, which can be used in particular as multipurpose additives for engine fuels, in particular for fuels used in spark ignition engines, in which they make it possible in particular to reduce the octane requirement increase (ORI) of these engines, and therefore to limit, delay or even avoid the appearance of knock, have now been discovered. It is very surprising that the additive compositions according to this invention combine their anti-ORI effect with a detergent effect in carburetors as well as injectors and inlet valves. They inhibit or extensively reduce the formation of deposits on inlet valves, and the fouling of carburettors or injectors. Furthermore these additive compositions retain their corrosion prevention properties with respect to the parts with which fuels come into contact, in both fuels used for spark ignition engines and those used for self-ignition engines (Diesel engines).

This invention relates to an additive composition, in particular for fuels, which comprises at least one constituent (A) and at least one constituent (B), the said constituent: (A) comprising at least one multinitrogen-containing compound incorporating two terminal rings of the imide type corresponding to the general formula (I):

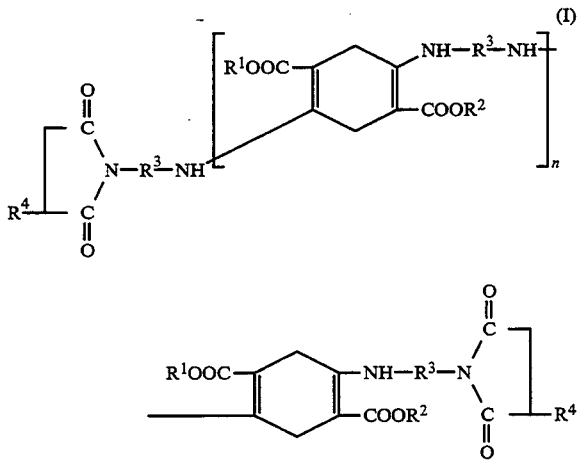

where $R^1$ and $R^2$ which are the same or different, each represent a hydrocarbon group having from 1 to 120 carbon atoms and a group of formula $R^5$—(O—$R^6$—)$_a$—(—O—$R^7$—)$_b$— in which $R^6$ and $R^7$, which are the same or different, each represent a divalent hydrocarbon group having from 2 to 6 carbon atoms, $R^5$ represents a monovalent hydrocarbon group having from 1 to 60 carbon atoms, a is zero or a whole number from 1 to 100 and b is a whole number from 1 to 100, $R^3$ is a divalent hydrocarbon group having from 2 to 60 carbon atoms or a divalent group of formula —$R^8$—(X—$R^9$—)$_c$—(—X—$R^{10}$—)$_d$—(—X—$R^{11}$—)$_e$—in which X is selected from the groups —O— and —$NR^{12}$—, $R^{12}$ representing a hydrogen atom or a hydrocarbon group having from 1 to 6 carbon atoms, $R^8$, $R^9$, $R^{10}$ and $R^{11}$, which are the same or different, each representing a divalent hydrocarbon group having from 2 to 6 carbon atoms, c is a whole number from 1 to 120, d and e, which are the same or different, are each zero or a whole number from 1 to 120 and the sum c+d+e is a whole number from 1 to 120, $R^4$ is a hydrogen atom or a hydrocarbon group having from 1 to 200 carbon atoms and n is a number from 0 to 20 and the said constituent (B) comprises at least one polyglycol which is soluble in the said fuel.

By way of examples of fuels which may contain at least one additive composition according to this invention, mention may be made of gasolines such as those defined by standard ASTM D-439, gasoils or Diesel fuels such as those defined by standard ASTM D-975. These fuels may also include other additives, such as for example, in particular in the case of fuels used in spark ignition engines, antiknock additives such as lead compounds (for example tetraethyl lead), ethers such as methyl tertiary butyl ether or methyl tertiary amyl ether or a mixture of methanol and tertiary butyl alcohol and antiicing additives. The additive compositions according to this invention may also be added to a non-hydrocarbon fuel such as for example an alcohol or a mixture of alcohols.

Constituent (A) is preferably selected from the compounds of general formula (I) above in which $R_1$ and $R^2$, which are the same or different, each represent most frequently a saturated or unsaturated straight or branched aliphatic group having from 1 to 60 carbon atoms and for example a straight or branched alkyl group having from 1 to 30 carbon atoms or a group of formula $R^5$—(—O—$R^6$—)$_a$—(—O$R^7$—)$_b$— in which $R^6$ and $R^7$, which are identical or different, each most frequently represent a divalent saturated or unsaturated straight or branched aliphatic group having from 2 to 4 carbon atoms and for example a straight or branched alkylene group having from 2 to 4 carbon atoms, such as for example an ethylene, trimethylene, propylene, tetramethylene and isobutylene group, $R^5$ most frequently represents a monovalent saturated or unsaturated straight or branched aliphatic group having from 1 to 20 carbon atoms and for example a straight or branched alkyl group having from 1 to 20 carbon atoms, a is most frequently zero or a whole number from 1 to 50 and b is most frequently a whole number from 1 to 50, or preferably a is zero or a whole number from 1 to 25 and b is preferably a whole number from 1 to 25, $R^3$ is most frequently a divalent saturated or unsaturated straight or branched aliphatic group having from 2 to 20 carbon atoms such as for example a straight or branched alkylene group having from 2 to 20 carbon atoms or a divalent group of formula —(—X—$R^{10}$—)$_d$—(—X—$R^{11}$—)$_e$— in which X is selected from the groups —O— and —NH—, $R^8$, $R^9$, $R^{10}$ *and* $R^{11}$, which are the same or different, each represent a divalent saturated or unsaturated straight or branched aliphatic group having from 2 to 4 carbon atoms, c is a whole number from 1 to 60, d and e, which are the same or different, are each zero or a whole number from 1 to 60 and the sum c+d+e is a whole number from 1 to 60, $R^4$ is most often a monovalent saturated or unsaturated straight or branched monovalent aliphatic group and preferably a straight or branched alkenyl group, or a group which forms with the methylene carbon of the imide ring a saturated or unsaturated and preferably unsaturated ring which may or may not be bridged having from 5 to 10 carbon atoms and preferably from 6 to 8 carbon atoms, the said group $R^4$ having from 6 to 150, and preferably from 6 to 100 and most frequently from 12 to 60 carbon atoms, n is most frequently a number from 0 to 10 and preferably from 0 to 5.

Among the multinitrogen-containing compounds (A) which can be used in particular in multipurpose additives for engine fuel according to the invention, those in which the group $R^4$ contains at least 6 and preferably at least 12 carbon atoms are normally used.

The multinitrogen-containing compounds (A) used ill this invention may be manufactured by any methods known to those skilled in the art. The following two methods will be quoted as non-restrictive examples of methods which may be used to prepare the compounds of general formula (I) above.

In accordance with the first method of preparation compounds of general formula (I) may be obtained by a method comprising the following steps:

a) at least one compound of general formula (III):

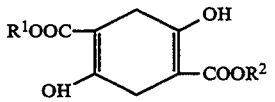

in which $R^1$ and $R^2$ have the meanings indicated above is reacted at a temperature of approximately 60° C. to approximately 160° C. in an inert organic solvent with at least one primary alpha-omega diamine of general formula $NH_2$—$R^3$—$NH_2$ in a molar 2ratio of diamine:- compound of general formula (III) from approximately 1.1:1 to approximately 10:1, preferably from approximately 1.2:1 to approximately 5:1 and for example 2:1 in such a way as to form the compound of general formula (II):

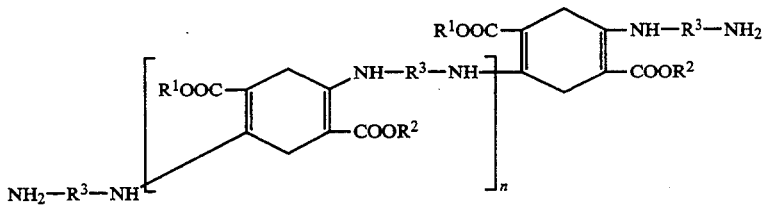

which $R^1$, $R^2$, $R^3$ have the meanings given above, and b) the compound of general formula (II) obtained in stage a) is reacted with an acid or derivative of a vicinal dicarboxylic acid at a temperature of approximately 30° C. to approximately 160° C. under conditions for the formation of imide rings and elimination of the volatile products formed, the quantity of acid or acid derivative used being approximately at least 2 moles per mole of compound of general formula (II) reacted, and the compound of general formula (I) formed is isolated by conventional means.

The esters of succinosuccinic acids which are most frequently used are commercial products which can be obtained easily by conventional methods of synthesis known to those skilled in the art. These esters may for example be obtained from dimethylsuccinocuccinate (DMSS) by transesterification. By way of non-restrictive examples of these esters mention may be made of esters deriving from methanol, ethanol, propanols, butanols, long chain primary or secondary alcohols such as ethyl-2-hexanol, alkyl monoethers of glycol or polyalkylene glycols such as alkylmonoethers of polypropyleneglycol, alky monoethers of polyethyleneglycol and alkylmonoethers of polypropylene and ethylene glycol. The alkyl group in these products most frequently contains at least 5 carbon atoms and is most frequently straight. By way of examples of alkyl groups, mention may be made of the N-pentyl and n-heptyl groups. These oxyalkylated products are commercial products sold by the SHELL company under the generic name OXYLUBE or by the ICI company. These compounds normally have a molecular mass of around 500 to around 2500 and most frequently from around 600 to around 2000. By way of example of these compounds mention may be made of those which are sold by the ICI company having a block structure of the $R^5$—O—+q1 (propylene oxide)+q2 (ethylene oxide) type in which $R^5$ represents an alkyl group having from 1 to 20 carbon atoms, q1 is the number of propylene oxide units and q2 is the number of ethylene oxide units.

The primary alpha-omega diamines normally employed are compounds well known to those skilled in the art. As specific compounds mention may be made by way of non-restrictive examples of: ethylenediamine, propylenediamine, diethylenetriamine, dipropylenetriamine, triethylenetetramine, tripropylenetetramine, triethylenepentamine, tetrapropylenepentamine, hexamethylenediamine, di(trimethylene)triamine, dimethyl-2,2-propane-1,3 diamine, N,N'-bis(amino-3-propyl)-ethylenediamine, (amino-2-ethyl)-amino-3-propylamine, trimethylhexamethylenediamines, among amines which contain no atoms of oxygen in their formulae. Among the amines which contain atoms of oxygen in their formulae, mention may be made of polyamines of formula:

$$NH_2—R^8—(—O—R^9—)_c——R^{10}—)_d—(—O—R^{11}—)_e—NH_2$$

in which preferably $R^8$, $R^9$, $R^{10}$ and $R^{11}$, which are identical or different, each represent an alkylidene group of 2 to 4 carbon atoms, for example ethylidene, propylidene, isopropylidene, butylidene, isobutylidene, c is preferably a whole number from 1 to 60 and d and e are equal to zero or c is a whole number from 1 to 59, e is zero or a whole number such that the sum c+e is from 1 to 59 and d is a whole number from 1 to 50, with in each case the sum c+d+e being equal to a whole number from 1 to 60.

As specific diamines mention may be made of those corresponding to the formulae $$NH_2—CH_2—CH_2\text{-}(O—CH_2—CH_2)_c\text{-}NH_2 \quad (A1)$$

$$NH_2—\underset{\underset{CH_3}{|}}{CH}—CH_2\left(O—CH_2—\underset{\underset{CH_3}{|}}{CH}\right)_c—NH_2 \quad (A2)$$

in which c is 2,3,5,6 or around 33, or of formula:

$$NH_2—\underset{\underset{CH_3}{|}}{CH}—CH_2\left(O—\underset{\underset{CH_3}{|}}{CH}—CH_2\right)_c—(O—CH_2—CH_2)_d—\left(O—CH_2—\underset{\underset{CH_3}{|}}{CH}\right)_e—NH_2 \quad (A3)$$

in which d is equal to approximately 8, 9, 15, 16 or 40 and c+e is approximately 2 or 3.

These products are in particular sold by the TEXACO Chemical Company under the name Jeffamine EDR 148 in the case of the product of formula (A1) in which c=2, Jeffamine D-230 for a product of formula (A2) of mean molecular mass 230, Jeffamine D-400 for a product of formula (A2) having a mean molecular mass of 400, Jeffamine D-2000 for a product of formula (A2) of mean molecular mass 2000, Jeffamine ED-600 for a product of formula (A3) of mean molecular mass 600, Jeffamine ED-900 for a product of formula (A3) of mean molecular mass 900 and Jeffamine ED-2001 for a product of formula (A3) of mean molecular mass 2000. Within the context of this invention one of several primary diamines may be used to synthesize the products of formula (I), (II) or (IV).

The acid or acid derivative normally used within the scope of this invention is a succinic compound or an alkylsuccinic or alkenylsuccinic compound, preferably an anhydride of the succinic type. A phthalic derivative, preferably phthalic anhydride or a phthalic anhydride bearing an alkyl group on one of the carbon atoms of the ring, may also be used. By way of examples of compounds of the succinic type, mention may be made of succinic anhydride, methylsuccinic anhydride, frequently known as citraconic anhydride, and alkylsuccinic or alkenylsuccinic anhydrides normally having a mean molecular mass of around 200 to 3000, preferably 500 to 2000 and most frequently 700 to 1500. These succinic derivatives are extensively described in the prior art; they are for example obtained by the action of at least one alpha olefin or chlorinated hydrocarbon on maleic acid or maleic anhydride. The alpha olefin or chlorinated hydrocarbon used in this synthesis may be straight or branched, and normally contain 10 to 150 carbon atoms, preferably from 15 to 80 carbon atoms and most frequently from 20 to 75 carbon atoms in their molecules. This olefin may also be an oligomer, for example a dimer, trimer or tetramer, or a polymer of a lower olefin having for example from 2 to 10 carbon atoms such as ethylene, propylene, n-but-1-ene, isobutene, n-hex-1-ene, n-oct-1-ene, methyl-2-hept-1-ene or methyl-2-propyl-5-hex-1-ene. Mixtures of olefins or mixtures of chlorinated hydrocarbons may also be used.

By way of examples of succinic anhydrides mention may be made of n-octadecenylsuccinic anhydride, dodecenylsuccinic anhydride and the polyisobutenylsuccinic anhydrides, frequently known as PIBSA, having a mean molecular mass as defined above.

In accordance with the second method of preparation compounds of general formula (I), in particular those in which n is equal to zero, may be obtained by a method comprising the following steps:

a) at least one primary alpha-omega diamine of general formula $NH_2—R_3—NH_2$ is reacted with an acid or a derivative of a vicinal dicarboxylic acid at a temperature of around 30° C. to around 160° C. under the conditions for the formation of imide rings and removal of the volatile products formed, the amount of acid or acid derivative used being approximately 1 mole per mole of diamine, so as to form a compound of general formula (IV):

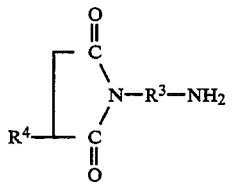

(IV)

$R^3$ and $R^4$ having the meanings given above, and b) the compound of general formula (IV) obtained in stage a) is reacted with the compound of general formula (III) in a molar ratio of approximately 2 moles of compound of general formula (IV) per mole of compound of general formula (III), under the conditions for the formation of a compound of general formula (I) in which n=0.

One or more primary diamines may be used to synthesise the products of formula (I), (II) or (IV) within the scope of this invention.

The additive compositions according to the invention also contain at least one constituent (B) selected from polyglycols which are soluble in the fuel and preferably having a mean molecular mass from 480 to 2100 and general formula (VII):

$$HO—R\left(O—R\right)_x O—R—OH \qquad (VII)$$

in which each of the R groups independently represents a hydrocarbon group having from 2 to 6 carbon atoms and x represents the mean level of polymerisation. These polyglycols are for example those described by the applicant in European patent application EP-A-439369.

In an advantageous embodiment constituent (B) is a polyglycol having a polydispersity index of approximately 1 to approximately 1.25 and preferably of approximately 1 to 1.15, of general formula (VII), in which each of the R groups independently represents a straight or branched alkylene group having from 2 to 4 carbon atoms, preferably an ethylene or propylene group.

Among the polyglycols of general formula (VII) which are particularly preferred, mention may be made of those in which each of the R groups represents a propylene group of formula:

$$CH_3—\underset{|}{CH}—CH_2—$$

polyglycol used is preferably a polyglycol of mean molecular mass from 600 to 1800 and most frequently from 650 to 1250.

In a preferred embodiment of this invention the additive compositions also comprise at least one constituent (C) selected from the group formed by detergent-dispersant products. This constituent (C) is normally selected from the group comprising polyolefins, preferably polyisobutenes, polyisobutene-amines, mixtures of these types of compounds and the products which are in particular described in European patent application EP-A-349369 in the name of the applicant, and those described in U.S. Pat. No. 4,375,974. The products described in application EP-A-349369 result from the reaction of at least one succinic derivative selected from the group comprising alkenylsuccinic acids and anhydrides and polyalkenylsuccinic acids and anhydrides with at least one 1-(2-hydroxyethyl)imidazoline substituted in the 2 position by a straight or branched alkyl or alkenyl radical having from 1 to 25 carbon atoms, the imidazoline/succinic derivative molar ratio being from 0.1:1 to 0.9:1, preferably from 0.2:1 to 0.8:1 and most frequently from 0.3:1 to 0.7:1, in a first stage, the said stage being carried out in such a way that at least 0.15 moles of water per mole of imidazoline involved is formed and eliminated, and reacting the product from the first stage with at least one polyamine having one of the following general formulae:

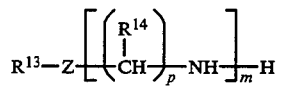

(V)

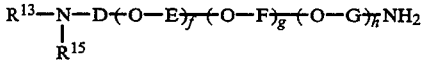

(VI)

in which $R^{13}$ represents a hydrogen atom or a hydrocarbon group having from 1 to 60 carbon atoms, in a second stage. Z is selected from the groups —O— and —$NR^{15}$— in which $R^{15}$ represents a hydrogen atom or a hydrocarbon group having from 1 to 60 carbon atoms. $R^{13}$ and $R^{15}$ may form a heterocyclic ring with the nitrogen atom with which they are linked, each of the $R^{14}$ independently represents a hydrogen atom or a hydrocarbon group having from 1 to 4 carbon atoms, p is a whole number from 2 to 6, m is a whole number from 1 to 10, when Z is —$NR^{15}$— and a whole number from 2 to 10 when Z is —O—, D, E, F and G, which are the same or different, each represent a divalent hydrocarbon group having from 2 to 6 carbon atoms, f is a whole number from 1 to 60, g and h, which are the same or different, are each zero or a whole number from 1 to 50 and the sum f+g+h is a whole number from 1 to 60, the amount of polyamine involved in the reaction being at least 0.1 mole per mole of succinic derivative added during the first stage. The total amount of substituted imidazoline and polyamine is preferably from 0.8 to 1.2 moles per mole of succinic derivative.

The succinic acid or anhydride used in the context of this invention to prepare constituent (C) is normally selected from those defined above within the scope of the preparation of compounds of general formula (I). The 1-(2-hydroxyethyl)imidazolines substituted in the 2 position by an alkyl or alkenyl radical having from 1 to 25 carbon atoms, used in the context of this invention to prepare constituent (C), are normally commercial compounds or compounds which can be synthesised for example by the reaction of at least one organic acid with N-(2-hydroxyethyl)ethylenediamine. The reaction proceeds by a first stage of amide formation followed by ring formation. The organic acids used normally have from 2 to 26 carbon atoms; they are preferably monocarboxylic aliphatic acids.

By way of examples mention may be made of acetic acid, propanoic acid, butanoic acid, caproic acid, capric acid, lauric acid, myristic acid, palmitic acid, stearic acid, behenic acid, cerotic acid and the following unsaturated fatty acids:

| | |
|---|---|
| CH3—CH2—CH=CH—(CH2)7—COOH | dodecylenic acid |
| CH3—(—CH2—)5—CH=CH—(—CH2—)7—COOH | palmitoleic acid |
| CH3—(—CH2—)7—CH=CH—(—CH2—)7—COOH | oleic acid |
| CH3—(—CH2—)5—CHOH—CH2—CH=CH—(—CH2—)7-COOH | ricinoleic acid |
| CH3—(—CH2—)10—CH=CH—(—CH2—)4—COOH | petroselenic acid |
| CH3—(—CH2—)5—CH=CH—(—CH2—)9—COOH | vaccenic acid |
| CH3—(—CH2—)4—CH=CH—CH2—CH=CH—(—CH2—)7-COOH | linoleic acid |
| CH3—(—CH2—)9—CH=CH—(—CH2—)7—COOH | gadoleic acid |
| CH3—(—CH2—)9—CH=CH—(—CH2—)9—COOH | cetolic acid |
| CH3—(—CH2—)7—CH=CH—(CH2—)11—COOH | erucic acid |
| CH3—(—CH2—)7—CH=CH—(—CH2—)13—COOH | selacholeic acid |

1-(2-hydroxyethyl)-2-heptadecenyl imidazoline, prepared for example from oleic acid and N-(2-hydroxyethyl)ethylenediamine may for example be used. This preparation is for example described in U.S. Pat. No. 2,987,515. Another example which may be mentioned is 1-(2-hydroxyethyl)-2-methyl imidazoline prepared for example from acetic acid and N-(2-hydroxyethyl)ethylenediamine-1-(2-hydroxyethyl)-2-heptadecenyl imidazoline is marketed by the CIBA-GEIGY company under the name "Amine-O" and by the PROTEX company under the name "Imidazoline-O".

The first stage in the preparation of constituent (C) is normally effected by progressively adding the imidazoline derivative to a solution of the succinic derivative in an organic solvent, at ambient temperature, followed by heating to a temperature normally between 65° C. and 250° C. and preferably between 80° C. and 200° C. The organic solvent used in this preparation has a boiling point between 65° C. and 250° C. and is normally selected so that the water formed in the course of the condensation of the imidazoline with the succinic derivative can be removed, preferably in the form of a water-organic solvent azeotrope. Normally an organic solvent such as for example benzene, toluene, xylenes, ethylbenzene or a hydrocarbon fraction such as for example the commercial cut SOLVESSO 150 (190°-209° C.), containing 99% by weight of aromatic compounds, is used. Mixtures of solvents may be used, for example a mixture of xylenes. The heating time after the end of imidazoline addition is normally from 0.5 to 7 hours, preferably from 1 to 5 hours. This first stage is preferably carried out at the selected temperature until no more water formed in the course of the reaction is released.

The amount of water removed in the course of this first stage is normally approximately 0.15 to 0.6 moles and most often around 0.5 moles per mole of imidazoline involved in the reaction. At least one polyamine, preferably diluted in an organic solvent, is added, preferably progressively, to the product or mixture resulting from this first stage, after cooling if appropriate, and then this is normally heated to a temperature lying between 65° C. and 250° C. and preferably between 80° C. and 200 C. The solvent used in the second stage is preferably the same as that used in the first stage and the temperature is also the same during both stages. The reactions are normally carried out at a temperature corresponding to the reflux temperature. The heating time during this second stage is normally from 0.1 to 7 hours and preferably from 0.2 to 5 hours. The amount of polyamine used is at least 0.1 mole per mole of succinic anhydride added during the first stage and is preferably such that the total amount of substituted imidazoline and polyamine used in the preparation is from 0.8 to 1.2 moles, preferably from 0.9 to 1.1 moles per mole of succinic derivative. The molar ratio of substituted imidazoline to polyamine is preferably 1:1 to 7:1 and most preferably from 1:1 to 3:1.

The amount of water removed during this second stage is normally such that the total amount of water removed during the two successive reactions represents from 0.2 to 0.7 moles per mole of succinic derivative.

The polyamines of formula (V) are preferably those in which $R^{13}$ is a hydrogen atom or a hydrocarbon group having from 1 to 30 carbon atoms, Z is preferably a —$NR^{15}$— group in which $R^{15}$ preferably represents a hydrogen atom or a hydrocarbon group having from 1 to 30 carbon atoms, each of the $R^{14}$ independently represents preferably a hydrogen atom or a methyl group, p is a whole number from 2 to 4 and when Z is a —$NR^{15}$— group m is preferably a whole number from 1 to 5.

Of the compounds of formulae (V) above, those in which Z is —$NR^{15}$—, $NR^{15}$—, $R^{13}$, $R^{14}$ and $R^{15}$ each represent a hydrogen atom, p is equal to 2 and m is a whole number from 1 to 5 or those in which $R^{13}$ represents a hydrocarbon group having preferably from 5 to 24 carbon atoms, Z represents a —$NR^{15}$— group in which $R^{15}$ is a hydrogen atom, $R^{14}$ represents a hydrogen atom, p is a whole number from 2 to 4, preferably 3, and m is a whole number from 1 to 5, preferably 1, are advantageously used.

The $R^{13}$ and $R^{15}$ hydrocarbon groups are normally straight or branched alkyl or alkenyl groups, aryl, arylalkyl (aralkyl), alkyl-aryl (alkaryl) or cycloaliphatic groups. The $R^{13}$ and $R^{15}$ groups are preferably straight or branched alkyl or alkenyl groups. The $R^{14}$ hydrocarbon group is normally a preferably straight alkyl group, and for example methyl, ethyl, n-propyl or n-butyl.

As specific compounds mention may be made of: the primary alpha-omega diamines mentioned above, trimethylenediamine, trimethyl-2,2,4- and 2,4,4-hexamethylenediamine, N-alkyl diamino-1,3-propanes for example N-dodecyldiamino-1,3-propane, N-tetradecyldiamino-1,3-propane, N-hexadecyldiamino-1,3-propane, N-octadecyldiamino-1,3-propane, N-eicosyldiamino-1,3 propane and N-docosyldiamino-1,3-propane; mention may also be made of N-alkyldipropylene triamines, for example N-hexadecyldipropylene triamine, N-octadecyldipropylene triamine, N-eicosyldipropylene triamine and N-docosyldipropylene triamine; mention may also be made of N-alkenyldiamino-1,3-propanes and N-alkenyldipropylene triamines, for example N-octadecenyldiamino-1,3-propane, N-hexadecenyldiamino-1,3-propane, N-dodecylenyldiamino-1,3-propane, N-octadecadienyldiamino-1,3-propane and N-docosenyldiamino-1,3-propane. By way of examples of disubstituted N,N diamines mention may be made of N,N-diethyldiamino-1,2-ethane, N,N-diisopropyl diamino-1,2-ethane, N,N-dibutyl diamino-1,2-ethane, N,N-diethyl diamino-1,4-butane, N,N-dimethyl diamino-1,3-propane, N,N-diethyldiamino-1,3-propane, N,N-dioctyldiamino-1,3-propane, N,N-didecyldiamino-1,3-propane, N,N-didodecyldiamino-1,3-propane, N,N-ditetradecyldiamino-1,3-propane, N,N-dihexadecyl diamino-1,3-propane, N,N-dioctadecyldiamino-1,3-propane, N,N-didocyldipropylene triamine, N,N-ditetracdecyldipropylene triamine, N,N-dihexadecyldipropylene triamine, N,N-dioctadecyldipropylene triamine, N-methyl, N-butyl diamino-1,2-ethane, N-methyl, N-octyl diamino-1,2-ethane, N-ethyl, N-octyl diamino-1,2-ethane, N-methyl, N-decyl diamino-1,2-ethane, N-methyl, N-dodecyl diamino-1,3-propane, N-methyl, N-hexadecyl, diamino-1,3-propane and N-ethyl, N-octadecyl diamino-1,3-propane.

By way of examples of ether amines mention may be made of N-(octyloxy-3-propyl)diamino-1,2-propane, N-(decyloxy-3-propyl)diamino-1,3-propane, N-[(trimethyl-2,4,6-decyl)oxy-3-propyl ] diamino-1,3-propane.

It should be understood that one or more compounds corresponding to formula (V) and/or (VI) may be used as the polyamine compound. As specific examples of mixtures of compounds having formula (V) mention may be made of:

cuts of fatty diamines having the formula $R^{13}$—N-H—$(CH_2)_3$—$NH^2$ in which the $R^{13}$ groups are aliphatic $C_8$, $C_{10}$, $C_{12}$, $C_{14}$, $C_{16}$, $C_{18}$, $C_{20}$, and $C_{22}$ hydrocarbon radicals in the approximate molar proportions given in Table I below.

TABLE I

| Alkyl chains Cut | $C_8$ | $C_{10}$ | $C_{12}$ | $C_{14}$ | $C_{16}$ | $C_{18}$ | $C_{18-1}$* | $C_{20}$ | $C_{22}$ |
|---|---|---|---|---|---|---|---|---|---|
| A | 0% | 0% | 0% | 1% | 28% | 71% | 0% | 0% | 0% |
| B | 0% | 0% | 0% | 1% | 5% | 42% | 0% | 12% | 40% |
| C | 3% | 6% | 56% | 18% | 10% | 2% | 5% | 0% | 0% |
| D | 0% | 0% | 0% | 0% | 16% | 4.9% | 79.1% | 0% | 0% |
| E | 0% | 0% | 0% | 2.3% | 31.8% | 24.2% | 39% | 2.7% | 0% |

*$C_{18-1}$ a chain including an ethylenic unsaturated bond.

The polyamines of formulae (VI) are preferably those in which $R^{13}$ and $R^{15}$ each represent a hydrogen atom, D, E, F and G, which are the same or different, each represent an alkylene group having from 2 to 4 carbon atoms, for example ethylene, trimethylene, methylethylene, tetramethylene, methyltrimethylene, methyl-1-trimethylene and methyl-2-trimethylene, f is a whole number from 1 to 60 and g and h are equal to zero or f is a whole number from 1 to 59, h is zero or a whole number such that the sum f+h is from 1 to 59 and g is a whole number from 1 to 50, with in each case the sum f+g+h being equal to a whole member from 1 to 60.

As specific compounds of formula (VI) mention may be made of the diamines of formulae (A1), (A2), and (A3) mentioned above. The products described by the applicant in patent U.S. Pat. No. 4,375,974 which can be used within the scope of this invention as constituent (C) are those which result from the reaction of at least one polyamine having at least one primary amine group and having the general formula (V) above with at least one succinic derivative such as those described above, the said reaction being performed under conditions in which water of reaction is formed and removed. Most frequently the reaction is performed at a temperature of from approximately 120° C. to approximately 200° C. with a molar ratio of amine to succinic derivative of approximately 0.9:1 to approximately 1.2:1. This reaction may be performed in the absence of solvent or in the presence of a solvent such as for example an aromatic hydrocarbon or a hydrocarbon cut having a boiling point of from around 70° C. to around 250° C.

Constituent (C) which can be used within the scope of this invention may also be selected from the group consisting of polyisobutenes, polyisobutene-amines, and mixtures of these two types of compounds. The polyolefins used may be polymers or copolymers or corresponding amine or hydrogenated derivatives formed from hydrocarbons having from 2 to 10 carbon atoms in their molecules. These polymeric compounds are normally prepared on the basis of monoolefin or diolefin compounds and normally have a mean molecular mass from around 500 to 10,000, frequently from around 500 to 3,500 and preferably from around 650 to 2,600. Most frequently the starting compounds used to manufacture these polymers are olefins having 2 to 6 carbon atoms in their molecules, such as for example ethylene, propylene, isopropylene, butene, isobutene, amylene, hexylene, butadiene and isoprene. Propylene, isopropylene, butene and isobutene are very frequently used. The other polyolefins which may also be used are those obtained by cracking olefin polymers or copolymers of high molecular mass into compounds having a molecular mass within the molecular mass range mentioned above.

By way of non-restrictive examples of specific compounds which are frequently used mention may be made of polypropylenes of mean molecular mass from around 750 to 1000 and for example around 800, polyisobutenes of mean molecular mass from around 1000 to 1500 and for example around 1300.

In another preferred embodiment according to this invention constituent (C) is a mixture comprising a major proportion of polyisobutene-ethylene diamine and a minor proportion of polyisobutene. This mixture is most frequently used dissolved in a hydrocarbon solvent so as to assist its incorporation with the fuel. The proportion of amine polymer within this mixture is normally from around 50% to around 80% by weight and for example around 60% by weight and the proportion of hydrocarbon polymer is normally from around 5% to around 30% by weight and preferably from around 10% to around 25% by weight.

Polyisobutene ethylene diamine is a compound having the general formula:

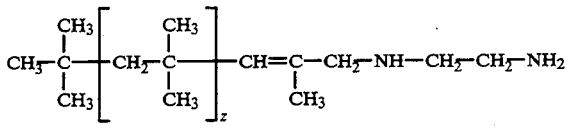

in which z is a number from around 10 to around 40, preferably from around 30 to around 35, and for example around 33.

Polyisobutene is a compound of general formula:

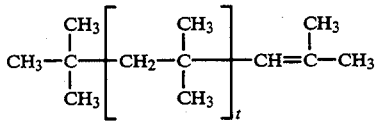

in which t is a number from around 10 to around 40, preferably from around 30 to around 35 and for example around 33.

The solvent used to dissolve the polymer compounds and assist their incorporation in the fuel is most often a light aromatic distillate. The product sold by the CHEVRON CHEMICAL COMPANY under the trade name ORONITE OGA-472 which comprises a polyisobutene or polyisobutene-ethylene-diamine as described above, dissolved in a light aromatic distillate, may be used as constituent (C). ORONITE OGA-472 is a composition comprising approximately 60% by weight of polyisobutene-ethylene-diamine, approximately 27% by weight of polyisobutene and approximately 30% by weight of a light aromatic distillate comprising xylene and $C_9$ alkyl benzenes.

The additive compositions according to the invention can in particular be used as an additive having good corrosion preventive properties for a fuel based on hydrocarbons or a mixture of hydrocarbons and at least one oxygenated compound selected from the groups comprising alcohols and ethers. These compositions can also be used as multipurpose additives having in particular good anti-ORI and detergent-dispersant properties for an engine fuel for spark ignition engines based on hydrocarbons or a mixture of hydrocarbons and at least one oxygenated compound selected from the group comprising alcohols and ethers. Normally these additive compositions are added to the fuel in such a way as to obtain a mass of the additive composition in the engine fuel of from 10 to 10,000 ppm by mass, often from 100 to 5000 ppm and preferably from 100 to 2000 ppm.

In additive compositions according to this invention the ratio by weight of constituent (A) to constituent (B) [(A)/(B)] is normally from approximately 0.05:1 to approximately 5:1. This ratio is frequently from around 0.05:1 to around 2:1 and preferably from around 0.1:1 to around 2:1. When the composition also includes a constituent (C) the ratio by weight of constituent (B) to constituent (C) [(B)/(C)] is normally from around 0.1:1 to around 50:1 and preferably from around 0.2:1 to around 20:1.

The following examples illustrate the invention without restricting its scope.

EXAMPLE 1 a) First stage 182.4 g (0.8 moles) of dimethylsuccinosuccinate (DMSS) and 2512 g (2.29 moles) of a polyoxypropyl and ethoxy monoalcohol (sold by the ICI company) containing 70% of primary alcohol groups and having a molecular mass of 1097 (i.e. an excess of 30%) was placed with stirring in a 2 liter double walled reaction vessel equipped with a stirrer, a dipping tube for the introduction of argon, a thermometer and a cooling jacket. The temperature was raised to 135° C. and then 11.6 g ($3.4\times10^{-2}$ moles) of butyltitanate $Ti\text{-}(OC_4H_9)_4$ was added and the temperature was then raised to 145° C. with continuous stirring. The Mixture was then held at a temperature of 145° C. with stirring for one hour and 30 minutes. A first methanol fraction was recovered at atmospheric pressure and then the pressure was progressively reduced using a water pump to a value of 27 KiloPascals (KPa) and an alcohol phase was recovered after condensation, (the flask temperature being held at 145° C.). Analysis by gas phase chromatography showed that the alcohol phase recovered in this way contained methanol, polyoxyalkylalcohol and butanol. The total amount of methanol recovered (51.2 g) was equivalent to the expected amount. The reaction vessel contained 1811 g of products, which after analysis by gel permeation chromatography contained 89.4% of polyoxyalkyl alcohol succinosuccinate, namely 1619 g (0.76 moles), equivalent to a molar DMSS conversion of 95%. The residual alcohols were removed by distillation under a partial pressure of 270 Pa at a temperature of 120° C. The product obtained was dissolved in xylene using a ratio of 1:1 by weight. The solution obtained in this way was called solution no. 1.

b) Second stage 0.2 moles of commercial trimethyl hexamethylene diamine (a mixture of trimethyl-2,2,4 and trimethyl-2,4,4-hexamethylene diamine) in the form of a 50% by weight solution in xylene was placed in a 2 liter double walled reaction vessel equipped with a stirrer, a dropping funnel, a thermometer and a Dean-Stark separator. 333 g of a 50% by weight solution of polyisobutenesuccinic anhydride containing 0.12 anhydride groups per 100 g, i.e. 0.2 moles, in xylene was added dropwise at ambient temperature with stirring. The temperature was then progressively raised until reflux of xylene occurred (140° C.). After 2 hours reaction at 140° C. 3.6 g of water was collected, which is equivalent to the theoretical quantity for the formation of a succinimide ring. 487 g of a solution called solution No. 2 was recovered from the reaction vessel. The product obtained was characterised by conventional analytical methods.

c) Third stage

A quantity of solution No.1 prepared during the first stage corresponding to 0.1 mole of the diester of succinosuccinic acid and polyoxyalkyl alcohol was placed in a reaction vessel identical to that used in the second stage. Solution No. 2 obtained in the second stage was added dropwise at ambient temperature with stirring. The temperature was raised progressively to 120° C. and 3.5 milliliters (ml) of water was recovered, i.e. 97% of the theoretical quantity for the formation of a product of formula (I) (2 moles of water per mole of diester) in which n=0. 568 g of a 50% by weight solution of the product in xylene was obtained. This solution was called additive 2. Additive 2 was analysed after evaporation of the solvent. Its mean molecular mass measured by a vapour pressure technique was 3000. The infrared spectrum showed the following characteristic bands: 1610 $cm^{-1}$ which can be attributed to the enamine double bond, 1660 $cm^{1}$ which can be attributed to the carbonyl bond of succinosuccinic ester anti the doublet characteristic of aliphatic succinimides at 1710 $cm^{-1}$ and 1770 $cm^{-1}$.

EXAMPLE 2 a) First stage 1000 g of a 50% by weight solution in xylene of polyoxypropylene-diamine of molecular mass 2000 (a product sold by the TEXACO company under the name Jeffamine D2000), i.e 0.25 moles of amine, were placed in a 2 liter double walled reaction vessel equipped with a stirrer, a dropping funnel, a thermometer and a Dean-Stark separator. 416.25 g of a 50% by weight solution in xylene of polyisobutene succinic anhydride containing 0.12 anhydride groups per 100 g, i.e. 0.25 moles, was added dropwise at ambient temperature with stirring. The temperature was then progressively raised to the reflux temperature of xylene (140° C.). After 2 hours reaction at 140° C. 4.5 g of water was recovered, equivalent to the theoretical quantity for the formation of a succinimide ring. A solution called solution No. 3 was obtained in the reaction vessel. The product obtained was characterised by conventional methods of analysis.

b) Second stage 0.1 moles of the methyl diester of succinosuccinic acid was added as a 50% by weight solution in xylene to a reaction vessel identical to that used in the first stage. Solution no. 3 obtained in the first stage was added dropwise at ambient temperature with stirring. The temperature was raised progressively to 120° C. and 3.5 milliliters (ml) of water was recovered, 97% of the theoretical amount for the formation of a product of formula (I) (2 moles of water per mole of diester) in which n=0. A solution of 50% by weight of the product in xylene was obtained. This solution was called additive 2. Additive 2 was analysed after evaporation of the solvent. Its mean molecular mass calculated using a vapour pressure technique was 5800. The infrared spectrum showed the following characteristic bands: 1610 $cm^{-1}$ which can be attributed to the enamine double bond, 1660 $cm^{-1}$ which can be attributed to the carbonyl bond of the succinosuccinic ester, and the doublet characteristic of aliphatic succinimides at 1710 cm−and 1770 $cm^{-1}$.

EXAMPLE 3 (detergent composition)

1018 g of polyisobutenylsuccinic anhydride (PIBSA) resulting from the condensation of polyisobutene (polyisobutene having a mean molecular mass of 920) with maleic anhydride (determination of the anhydride groups in this product shows that there were 0.7 anhydride groups per kilogram) and 1018 g of xylene were placed in a 2 liter reaction vessel fitted with a mechanical stirrer, a DEAN-STARK separator and a temperature control system. 148 g (0.423 moles) of 1-(2-hydroxy-ethyl)-2-heptadecenyl imidazoline diluted in 148 g of xylene was then added dropwise at ambient temperature and with stirring. The addition was performed over 30 minutes and accompanied by a rapid increase of some 5° C. in the temperature of the reaction mixture. The mixture was then refluxed for 3 hours with removal of the water of reaction by azeotropic distillation. The amount of water recovered was 2.3 ml (milliliters). The progress of the reaction could also be followed by infrared spectrometry using the absorption band of the imine group at 1660 $cm^{-1}$, which disappeared progressively through the course of the reaction.

The temperature of the reaction vessel was reduced to 50° C. and then held at this value for the time required for the progressive (dropwise) addition of 56 g (0.297 moles) of tetraethylene pentamine diluted in 49 g of xylene. After this addition had been made the mixture was again refluxed for 15 minutes. More water was removed. The total amount of water recovered during these two reaction stages was 7.2 ml. The infrared spectrum showed two absorption bands (1710 $cm^{-1}$ and 1770 $cm^{-1}$), characteristic of the succinimide group, with a shoulder (1740 $cm^{1}$) characteristic of the ester group.

A solution of a composition containing 50% by weight of active material in xylene, for which elemental analysis showed a nitrogen content of 2.55% by weight, was obtained in this way.

EXAMPLE 4

Solutions in xylene of compositions F1 to F5 containing different quantities by weight of constituents (A), (B) and (C) defined below were prepared. Constituent (A) comprised one of the compositions obtained in examples 1 and 2.

Constituent (B) was a polypropyleneglycol of formula:

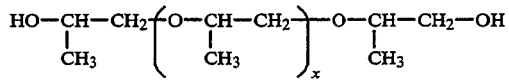

for which the mean molecular mass was 922 (x=13.6), with a polydispersity of 1.1.

Constituent (C) consisted of the composition obtained in example 3.

Composition F1 according to this invention contained constituent (A) comprising the composition obtained in example 1, constituent (B) comprising the polypropyleneglycol described above and constituent (C) comprising the composition obtained in example 3.

These constituents were used in a ratio by weight in terms of active material A:B:C of 1:5:5.

Composition F2 according to this invention contained constituent (A) comprising the composition obtained in example 2, constituent (B) comprising the polypropyleneglycol described above and constituent (C) comprising the composition obtained in example 3. These constituents were used in a ratio by weight in terms of active material A:B:C of 1:5:5.

Composition F3 (comparison composition) contained constituent (B) comprising the polypropyleneglycol described above and constituent (C) comprising the composition obtained in example 3, but no constituent (A). The ratio by weight of active material B: C was 1:1.

Composition F4 (comparison composition) contained constituent (A) comprising the composition obtained in example 1 and constituent (C) comprising the composition obtained in example 3, but no constituent (B). The ratio by mass of active material A:C was 1:5.

Composition F5 according to this invention contained constituent (A) comprising the composition obtained in example 1 and constituent (B) comprising the polypropyleneglycol described above, but not constituent (C). The ratio by weight of active material A:B was 1:5.

EXAMPLE 5

A series of tests were performed in order to evaluate the properties of reducing the octane requirement increase of an engine fed with a single fuel and a fuel containing one of the additive compositions described in example 4. The fuel used was a lead-free fuel comprising by volume:

30% of aromatics
5% olefins and
65% of saturated compounds (paraffins and naphthenes)

The various additive compositions were added to the fuel in such a way as to obtain a concentration by weight of active material of 660 ppm. The tests were performed on an engine test bench fitted with a Renault type F2N engine having a capacity of 1721 $cm^3$ and a compression ratio of 9.5. These tests were performed using the modified Renault 22700 procedure with a temperature of 95° C. plus or minus 2° C. for the water leaving the cylinder head and an inlet oil temperature of 140° C. The test cycle lasted for 12 hours (h) and comprised:

1 h of slow running under no load,
4 h at 2500 revolutions per minute (rpm) at half full load,
3 h at 3500 rpm under no load and
4 h at 2500 revolutions per minute (rpm) at half full load.

The advance settings corresponding to the onset of knock and expressed as crankshaft degrees, and very frequently described by the initials KLSA (the English initials for "Knock Limit Spark Advance") were determined once at 0 and 150 hours under different engine operating conditions. The results obtained are expressed as KLSA at 150 hours for seven different engine operating conditions: 1500 rpm, 2000 rpm, 2500 rpm, 3000 rpm, 3500 rpm, 4000 rpm and 4500 rpm. These results are illustrated in Table II below. The overall weight (expressed in grams (g)) of the deposits on the 4 inlet valves was also measured and the results are provided in Table II. These results show: that the compositions according to the invention provide lower KLSA values, reduce the increase in engine octane requirement and delay the onset of unstable slowing, and also that with the additive compositions according to the invention the weight of the deposits on the inlet valves is greatly reduced with respect to what is obtained with fuel alone or with fuel containing the comparison additive compositions. It was also found that composition F5 according to the invention (but which is not one of the preferred compositions according to the invention) is effective from the point of view of limiting the engine octane increase requirement and delays the onset of unstable slowing but is not very effective in limiting the weight of the deposits on the inlet valves.

TABLE II

| KLSA at | fuel alone | fuel + F1 | fuel + F2 | fuel + F3 | fuel + F4 | fuel + F5 |
|---|---|---|---|---|---|---|
| 1500 | 13 | 12 | 12 | 13 | 13 | 12 |
| 2000 | 15 | 15 | 15 | 16 | 15 | 15 |
| 2500 | 22 | 19 | 19 | 21 | 20 | 20 |
| 3000 | 23 | 21 | 21 | 24 | 23 | 22 |
| 3500 | 24 | 22 | 22 | 24 | 23 | 22 |
| 4000 | 28 | 24 | 23 | 26 | 25 | 25 |
| 4500 | 30 | 26 | 26 | 28 | 28 | 27 |
| Deposits g | 1.8 | 0.5 | 0.5 | 0.5 | 0.8 | 1.2 |

*Comparison

EXAMPLE 6

The "carburettor" detergency properties of the additive compositions prepared in example 4 were evaluated. The engine test procedure was carried out in accordance with European Standard $R^5$-CEC-F03-T-81. The results are expressed in terms of scores from zero to ten. A score of 10 corresponds to a clean carburettor and a score of 0 to a very fouled carburettor. The additive compositions were added to the fuel in such a way as to obtain a concentration by weight of active material in the fuel as specified for each example in Table II below, which shows the results obtained:

TABLE III

| FUEL ADDITIVE | AMOUNT OF ADDITIVE | SCORE |
|---|---|---|
| *Fuel alone | 0 ppm | 4.1 |
| Fuel + composition F1 | 660 ppm | 9.7 |
| Fuel + composition F2 | 660 ppm | 9.8 |
| Fuel + composition F3 | 660 ppm | 9.6 |
| Fuel + composition F4 | 660 ppm | 9.4 |
| Fuel + composition F5 | 660 ppm | 9.7 |

*Comparison

The fuel used in these evaluations was a lead-free super fuel having a motor octane number of 85.3 and a research octane number of 96.7. This super fuel had an initial boiling point of 36° C. and a final boiling point of 203° C.

This super fuel comprised by volume:

50% of saturated compounds (paraffins+naphthenes)
8% of olefins
30% of aromatics
12% of methyl-t-butylether

EXAMPLE 7

Another series of tests was performed to evaluate the "carburettor" detergency properties of the additive compositions prepared in example 4. The tests were performed using the procedure described in example 6.

The fuel used in these tests was a super fuel with added lead alkyls containing 0.15 g of lead per liter, comprising by volume:

30 % of aromatics

8% of olefins

62% of saturated compounds (paraffins+naphthenes).

This fuel had a motor octane number of 86 and a research octane number of 96. The additive compositions were added to the fuel in such a way as to obtain a concentration by weight of active material in the fuel as specified in Table IV below, which shows the results obtained:

TABLE IV

| FUEL ADDITIVE | AMOUNT OF ADDITIVE | SCORE |
|---|---|---|
| *Fuel alone | 0 ppm | 4.2 |
| Fuel + composition F1 | 660 ppm | 9.7 |
| Fuel + composition F2 | 660 ppm | 9.8 |
| Fuel + composition F3 | 660 ppm | 9.7 |
| Fuel + composition F4 | 660 ppm | 9.4 |
| Fuel + composition F5 | 660 ppm | 9.7 |

*Comparison

EXAMPLE 8

The "injector" detergency properties of the additive compositions prepared in example 4 were evaluated.

The motor test procedure was carried out in accordance with method IFP-TAE I 87 prepared by the Institut Francais du Pétrole, as described below. The tests were performed on a Peugeot XU5JA engine test bench in accordance with a cyclic procedure over a total period of 150 hours corresponding to repetition of the following cycle:

15 minutes operation at 3000 rpm under a load of 18 kilowatts (kW)

45 minutes with the engine stopped.

The flow through each injector was measured at the beginning and the end of the test to evaluate the percentage restriction in flow caused by fouling of the injectors.

The fuel used in these tests was as super fuel with added lead alkyls containing 0.4 g of lead per liter, comprising by volume:

32% of aromatics

20% of olefins

48% of saturated compounds (paraffins+naphthenes)

This fuel had a motor octane number of 85.7 and a research octane number of 97.5.

The compositions were added to the fuel in such a way as to obtain a concentration by weight of active material in the fuel as specified in each example in Table V below, which shows the results obtained:

TABLE V

| FUEL ADDITIVE | AMOUNT OF ADDITIVE | PERCENTAGE RESTRICTION IN INJECTOR FLOW AFTER 150 HOURS (MEASURED AT 6000 rpm) |
|---|---|---|
| *Fuel alone | 0 ppm | 18.6% |
| Fuel + composition F1 | 660 ppm | 0.2% |
| Fuel + composition F2 | 660 ppm | 0.1% |

TABLE V-continued

| FUEL ADDITIVE | AMOUNT OF ADDITIVE | PERCENTAGE RESTRICTION IN INJECTOR FLOW AFTER 150 HOURS (MEASURED AT 6000 rpm) |
|---|---|---|
| Fuel + composition F3 | 660 ppm | 0.3% |
| Fuel + composition F4 | 660 ppm | 0.2% |
| Fuel + composition F5 | 660 ppm | 0.2% |

*Comparison

EXAMPLE 9

A series of tests was performed in order to evaluate the "inlet valve" detergency properties of the additive compositions prepared in example 4.

The engine test procedure used was that described in the literature published by the S.A.E. (the English initials of the "Society of Automotive Engineers") under reference SAE892121 (1989).

The tests were performed on a Honda generator unit equipped with a generator (240 Volt, 5500 Watt) driven by a two cylinder 359 $cm^3$ 4-stroke engine with inclined valves.

Each test was continued for a period of 80 hours in accordance with the following cyclical procedure:

1 hours operation with a generated output of 1500 W (quarter load)

1 hours operation with a generated output of 2500 W (half load).

At the start of each test the engine was reconditioned with new valves, which were weighed. At the end of the test the valves were removed, washed with hexane, dried, and then weighed after physical removal (by scraping) of the deposits formed on the combustion chamber side of the valve. The results shown below show the average deposit by weight upon a valve, calculated on the basis of the measured weight of deposits on the stem of each inlet valve, as the difference between the weight of the said valve when new and the weight of the said valve at the end of each test after the deposits on the combustion chamber side had been removed.

The fuel used in these tests was a lead-free super fuel identical to that described in example 5.

Additive compositions were added to the fuel in such a way as to obtain a concentration by weight of active material in the fuel as specified for each example in Table VI below, which also shows the results obtained.

TABLE VI

| FUEL WITH ADDITIVE | AMOUNT OF ADDITIVE | AVERAGE DEPOSITS IN mg | PERCENTAGE REDUCTION DEPOSITS/ FUEL ALONE |
|---|---|---|---|
| *Fuel only | 0 ppm | 82 | — |
| Fuel + composition F1 | 660 ppm | 4 | 95% |
| Fuel + composition F2 | 660 ppm | 3 | 96% |
| Fuel + composition F3 | 660 ppm | 5 | 94% |
| Fuel + | 660 ppm | 5 | 94% |

TABLE VI-continued

| FUEL WITH ADDITIVE | AMOUNT OF ADDITIVE | AVERAGE DEPOSITS IN mg | PERCENTAGE REDUCTION DEPOSITS/ FUEL ALONE |
|---|---|---|---|
| composition F4 | | | |
| Fuel + composition F5 | 660 ppm | 4 | 95% |

*Comparison

EXAMPLE 10

The corrosion preventing properties of the additive compositions prepared in example 4 were evaluated. The tests consisted of determining the amount of corrosion produced on ordinary polished steel samples in the presence of water in accordance with a modified standard ASTMD 665 (temperature 32.2° C., time 20 hours). The results were expressed as a percentage (%) of the surface area of the corroded test piece after 20 hours. The fuel was the same as that used in example 5. The amount of composition added active material in the fuel as specified for each example in Table VII below, which also shows the results obtained:

TABLE VII

| FUEL PLUS ADDITIVE | AMOUNT OF ADDITIVE | % CORRODED SURFACE AREA |
|---|---|---|
| *Fuel alone | 0 ppm | 0 |
| Fuel + composition F1 | 660 ppm | 0 |
| Fuel + composition F2 | 660 ppm | 0 |
| Fuel + composition F3 | 660 ppm | 0 |
| Fuel + composition F4 | 660 ppm | 0 |
| Fuel + composition F5 | 660 ppm | 0 |

*Comparison

EXAMPLE 11

Tests were performed in order to evaluate the corrosion preventing properties of the additive compositions according to the invention prepared in example 4. The tests were carried out in a similar way to those described in example 10 (temperature 60° C., time 20 hours) in a diesel fuel. The diesel fuel used had the following principal characteristics:

Limiting filterability temperature: −4° C.
Initial distillation point: 160° C.
95% distillation point: 370° C.
Density at 15° C.: 0.84
Calculated cetane number: 52

An amount of composition was added to the fuel in such a way as to obtain a concentration by weight of active material in the fuel as specified for each example in Table VII below, which also shows the results obtained:

TABLE VIII

| FUEL PLUS ADDITIVE | AMOUNT OF ADDITIVE | % CORRODED SURFACE AREA |
|---|---|---|
| *Fuel alone | 0 ppm | 0 |
| Fuel + composition F1 | 660 ppm | 0 |
| Fuel + composition F2 | 660 ppm | 0 |
| Fuel + | 660 ppm | 0 |

TABLE VIII-continued

| FUEL PLUS ADDITIVE | AMOUNT OF ADDITIVE | % CORRODED SURFACE AREA |
|---|---|---|
| composition F3 | | |
| Fuel + composition F4 | 660 ppm | 0 |
| Fuel + composition F5 | 660 ppm | 0 |

*Comparison

Analysis of the results obtained in the above examples shows that the compositions according to this invention very significantly restrict the octane requirement increase of spark ignition engines and have the qualities of detergent additives for the inlet system as well as corrosion-preventing properties.

When used in a Diesel fuel these additive compositions also have corrosion-preventing properties.

We claim:

1. An additive composition suitable for fuels comprising at least one constituent (A) and at least one constituent (B), the said constituent (A) comprising at least one multi-nitrogen-containing compound incorporating two terminal rings of the imide type according to the general formula (I):

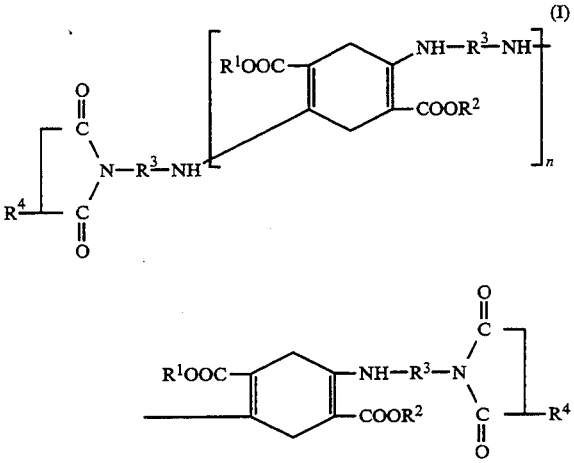

(I)

in which $R^1$ and $R^2$, which are the same or different, each represent a hydrocarbon group having from I to 120 carbon atoms or a group of formula $R^5$—(O—$R^6$—)$_a$—(—O—$R^7$)$_b$— in which $R^6$ and $R^7$, which are the same or different, each represent a divalent hydrocarbon group having from 2 to 6 carbon atoms, $R^5$ represents a monovalent hydrocarbon group having from 1 to 60 carbon atoms, a is zero or a whole number from 1 to 100 and b is a whole number from I to 100, $R^3$ is a divalent hydrocarbon group having from 2 to 60 carbon atoms or a divalent group of formula —$R^8$—(—X—$R^9$—)$_c$—(—X—$R^{10}$—)$_d$—(—X—$R^{11}$—)$_e$ in which X is selected from the groups —O — and —$NR^{12}$—, $R^{12}$ being a hydrogen atom or a hydrogen group having from 1 to 6 carbon atoms, $R^8$, $R^9$, $R^{10}$ and $R^{11}$, which are the same or different, each representing a divalent hydrocarbon group having from 2 to 6 carbon atoms, C is a whole number from 1 to 120, d and e, which are the same or different, are each zero or a whole number from 1 to 120 and the sum c+D+e is a whole number from 1 to 120, $R^4$ is a hydrogen atom or a hydrocarbon group having from 1 to 200 carbon atoms and n is a number from 0 to 20 and the said constituent (B) comprises at least 1 polyglycol which is soluble in a fuel containing at least one of a hydrocarbon and an alcohol.

2. An additive composition according to claim 1, in which constituent (A) is selected from compounds of general formula (I) in which $R^1$ and $R^2$, which are the same or different, each represent a straight or branched saturated or unsaturated aliphatic group having from 1 to 60 carbon atoms or a group of formula $R^5$—(—O—$R^6$—)$_a$—(—O$R^7$—)$_b$— in which $R^6$ and $R^7$, which are the same or different, each represent a straight or branched saturated or unsaturated divalent aliphatic group having from 2 to 4 carbon atoms, $R^5$ represents a straight or branched saturated or unsaturated monovalent aliphatic group having from 1 to 20 carbon atoms, a is zero or a whole number from 1 to 50 and b is a whole number from 1 to 50, $R^3$ is a straight or branched saturated or unsaturated divalent aliphatic group having from 2 to 20 carbon atoms or a divalent group of formula —$R^8$—(X—$R^9$—)$_c$—(—X—$R^{10}$—)$_d$—(—X—$R^{11}$—)$_e$—in which X is selected from the groups —O—and —NH—, $R^8$, $R^9$, $R^{10}$ and $R^{11}$ which are the same or different, each represent a straight or branched saturated or unsaturated divalent aliphatic group having from 2 to 4 carbon atoms, c is a whole number from 1 to 60, d and e, which are the same or different, are each zero or a whole number from 1 to 60 and the sum c+d+e is a whole number from 1 to 60, $R^4$ is a straight or branched saturated or unsaturated monovalent aliphatic group or a group which forms a saturated or unsaturated ring, which may or may not be bridged, having from 5 to 10 carbon atoms, with the methylene carbon of the imide ring, the said $R^4$ group having from 6 to 150, n is a number from 0 to 10.

3. An additive composition according to claims 1 in which constituent (A) is selected from compounds of general formula (I) in which $R^1$ and $R^2$ which are the same or different, each represent a straight or branched alkyl group having from 1 to 30 carbon atoms for a group of formula $R^5$—(—O—$R^6$—)$_a$—(—O$R^7$—)$_b$— in which $R^6$ and $R^7$, which are the same or different, each represent a straight or branched alkylene group having from 2 to 4 carbon atoms, $R^5$ represents a straight or branched alkyl group having from 1 to 20 carbon atoms, a is zero or a whole number from 1 to 25 and b is a whole number from 1 to 25, $R^3$ is a straight or branched alkylene group having from 2 to 20 carbon atoms or a divalent group of formula —$R^8$—(—X—$R^9$—)$_c$—(X—$R^{10}$—)$_d$—(—X—$R^{11}$—)$_e$— in which X is selected from the groups —O— and —NH—, $R^8$, $R^9$, $R^{10}$ and $R^{11}$ which are the same or different, each represent a straight or branched saturated or unsaturated divalent aliphatic group having from 2 to 4 carbon atoms, c is a whole number from 1 to 60, d and e, which are the same or different, are each zero or a whole number from 1 to 60 and the sum c+d+e is a whole number from 1 to 60, $R^4$ is a straight or branched alkenyl group or a group which forms an unsaturated ring, which may or may not be bridged, having from 6 to 8 carbon atoms, with the methylene carbon of the imide ring, the said $R^4$ group having from 6 to 100, n is a number from 0 to 5.

4. An additive composition according to one of claim 1, in which constituent (A) is selected from compounds of general formula (I) in which $R^6$ and $R^7$ which are the same or different, each represent an ethylene, trimethylene, propylene, tetramethylene or isobutylene group and $R^4$ is a group having from 12 to 60 carbon atoms.

5. An additive composition according to claim 1 in which constituent (B) is a polyglycol having a mean molecular mass from 480 to 2100 and general the formula (VII):

$$HO—R\left(O—R\right)_x O—R—OH \qquad (VII)$$

in which each of the R groups independently represents a hydrocarbon group having from 2 to 6 carbon atoms and x represents the mean level of polymerisation.

6. An additive composition according to claim 5, in which constituent (B) is a polyglycol having a polydispersity index of approximately 1 to approximately 1.25, of general formula (VII) in which each of the R groups independently represents a straight or branched alkylene group having from 2 to 4 carbon atoms.

7. An additive composition according to claim 5 in which constituent (B) is a polyglycol of general formula (VII) in which each of the R groups represents a propylene group of formula:

$$CH_3—\underset{|}{CH}—CH_2—$$

of mean molecular mass from 600 to 1800.

8. An additive composition according to claim 1 further comprising at least one constituent (C) selected from the group consisting of detergent-dispersant products.

9. An additive composition according lo claim 8 in which constituent (C) is selected from the group consisting of polyolefins, polyisobuteneamines, mixtures thereof, products resulting from the reaction of at least one succinic derivative selected from the group consisting of alkenyl succinic acids and anhydrides and polyalkenylsuccinic acids and anhydrides in a first stage with at least one 1-(2-hydroxyethyl)imidazoline substituted in the 2-position by a straight or branched alkyl or alkenyl radical having from 1 to 25 carbon atoms, the imidazoline/succinic derivative molar ratio being from 0. 1:1 to 0.9:1, the stage being carried out in such a way that at least 0. 15 moles of water per mole of imidazoline involved are formed and removed, and from the reaction in a second stage of the product from the first stage with at least one polyamine having one of the following general formulae:

$$R^{13}—Z\left[\left(\underset{|}{CH}\left(R^{14}\right)\right)_p NH\right]_m H \qquad (V)$$

$$R^{13}—\underset{\underset{R^{15}}{|}}{N}—D\left(O—E\right)_f\left(O—F\right)_g\left(O—G\right)_h NH_2 \qquad (VI)$$

in which $R^{13}$ represents a hydrogen atom or a hydrocarbon group having from 1 to 60 carbon atoms, Z is selected from the groups O—, —$NR^{15}$ represents a hydrogen atom or a hydrocarbon group having from 1 to 60 carbon atoms, $R^{13}$ and $R^{15}$ can form a heterocyclic ring together with the nitrogen atom to which they are connected, each of the $R^{14}$ independently represents a hydrogen atom or a hydrocarbon group having from 1 to 4 carbon atoms, p is a whole number from 2 to 6, m is a whole number from 1 to 10 when Z is —$NR^{15}$— and a whole number from 2 to 10 when Z is —O—, D, E, F and G, which are the same or different, each represent a divalent hydrocarbon group having from 2 to 6 carbon atoms, f is a whole number from 1 to 60, g and h, which are the same or different, are each zero or a whole number from 1 to 50 and the sum f+g+h is a whole number from 1 to 60, the amount of polyamine reacted being at least 0.1 mole per mole of succinic derivative added to the first stage.

10. An additive composition according to claim 8 in which constituent (C) is selected from the group consisting of products resulting from the reaction in a first stage of at least one succinic derivative selected from alkenylsuccinic or polyalkenylsuccinic anhydrides of mean molecular mass from 200 to 3000 with at least one 1-(2-hydroxyethyl)imidazoline substituted in the 2 position selected from 1-(2-hydroxyethyl)-2-heptadecenylimidazoline and 1-(2-hydroxyethyl)-2-methylimidazoline, and from the reaction in a second stage of the product from the first stage with at least one polyamine having one of the following general formulae:

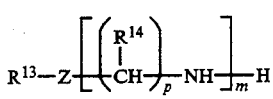

(V)

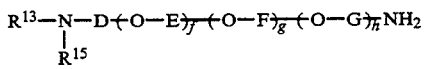

(VI)

in which Z represents an —$NR^{15}$— group, $R^{13}$, $R^{14}$ and $R^{15}$ each represent a hydrogen atom, p is equal to 2 and m is a whole number from 1 to 5, D, E, F and G, which are the same or different, each represent an alkylene group having from 2 to 4 carbon atoms, f is a whole number from 1 to 60 and g and h are equal to zero or f is a whole number from 1 to 59, h is zero or a whole number such that the sum f +h is from 1 to 59 and g is a whole number from 1 to 50 so that in each case the sum f+g+h is equal to a whole number from 1 to 60.

11. An additive composition according to claim 8 in which constituent (C) is selected from the group consisting of polyisobutenes, polyisobutene-amine, and mixtures thereof.

12. A fuel composition having a major proportion of hydrocarbons or a mixture of hydrocarbons and at least one oxygenated compound selected from the group consisting of alcohols and ethers, and a minor proportion of at least one additive composition according to claim 1.

13. In operating spark ignition engines comprising adding fuel to said engines, the improvement wherein said fuel is a fuel composition according to claim 12.

14. A fuel composition according to claim 12 in which from to 10000 ppm by weight of the additive composition is added to the fuel.

15. A fuel composition according to claim 14 in which the additive composition comprises constituents (A) and (B) in a ratio by weight (A)/(B) of approximately 0.05:1 to approximately 5:1.

16. A fuel composition according to claim 15 in which the additive composition also incorporates a constituent (C) selected from the group consisting of detergent-dispersant products in a quantity by weight such that the ratio by weight (B)/(C) is approximately 0.1:1 to approximately 50:1.

17. An additive composition according to claim 8, wherein component (C) is a mixture containing a minor proportion of polyisobutenes and a major proportion of polyisobutene-ethylene-diamines.

18. An additive composition according to claim 6, wherein R represents ethylene.

19. An additive composition according to claim 6, wherein R represents propylene.

20. An additive composition according to claim 7, wherein the mean molecular mass is from 650 to 1250.

21. A fuel composition according to claim 12 in which the additive composition comprises constituents (A) and (B)in a ratio by weight (A)/(B) of approximately 0.05:1 to approximately 5:1.

22. A fuel composition according to claim 15 in which constituent (C) is selected from the group consisting of polyolefins, polyisobuteneamines, mixtures thereof, products resulting from the reaction of at least one succinic derivative selected from the group consisting of alkenyl succinic acids and anhydrides and polyalkenylsuccinic acids and anhydrides in a first stage with at least one 1-(2-hydroxyethyl)imidazoline substituted in the 2-position by a straight or branched alkyl or alkenyl radical having from 1 to 25 carbon atoms, the imidazoline/succinic derivative molar ratio being from 0.1:1 to 0.9:1, the stage being carried out in such a way that at least 0.15 moles of water per mole of imidazoline involved are formed and removed, and from the reaction in a second stage of the product from the first stage with at least one polyamine having one of the following general formulae:

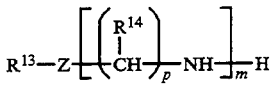

(V)

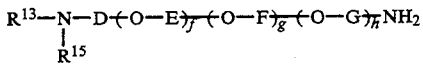

(VI)

in which $R^{13}$ represents a hydrogen atom or a hydrocarbon group having from 1 to 60 carbon atoms, Z is selected from the groups O—, —$NR^{15}$ represents a hydrogen atom or a hydrocarbon group having from 1 to 60 carbon atoms, $R^{13}$ and $R^{15}$ can form a heterocyclic ring together with the nitrogen atom to which they are connected, each of the $R^{14}$ independently represents a hydrogen atom or a hydrocarbon group having from 1 to 4 carbon atoms, p is a whole number from 2 to 6, m is a whole number from 1 to 10 when Z is —$NR^{15}$— and a whole number from 2 to 10 when Z is —O—, D, E, F and G, which are the same or different, each represent a divalent hydrocarbon group having from 2 to 6 carbon atoms, f is a whole number from 1 to 60, g and h, which are the same or different, are each zero or a whole number from 1 to 50 and the sum f+g+h is a whole number from 1 to 60, the amount of polyamine reacted being at least 0.1 mole per mole of succinic derivative added to the first stage.

23. A fuel composition according to claim 15 in which constituent (C) is selected from the group consisting of products resulting from the reaction in a first stage of at least one succinic derivative selected from alkenylsuccinic or polyalkenylsuccinic anhydrides of mean molecular mass from 100 to 3000 with at least one 1-(2-hydroxyethyl)imidazoline substituted in the 2-position selected from 1-(2-hydroxyethyl)-2-heptadecenylimidazoline and 1-(2-hydroxethyl)-2-methylimidazoline, and from the reaction in a second stage of the product from the first stage with at least one polyamine having one of the following general formulae:

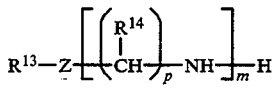

(V)

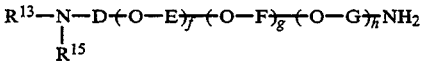

(VI)

in which Z represents an —$NR^{15}$— group, $R^{13}$, $R^{14}$ and $R^{15}$ each represent a hydrogen atom, p is equal to 2 and m is a whole number from 1 to 5, D, E, F and G, which are the same or different, each represent an alkylene group having from 2 to 4 carbon atoms, f is a whole number from 1 to 60 and g and h are equal to zero or f is a whole number from 1 to 59, h is zero or a whole number such that the sum f+h is from 1 to 59 and g is a whole number from 1 to 50 so that in each case the sum f+g+h is equal to a whole number from 1 to 60.

24. A fuel composition according to claim 15 in which constituent (C) is selected from the group consisting of polyisobutenes, polyisobutene-amines, and mixtures thereof.

25. A fuel composition according to claim 15 wherein component (C) is a mixture containing a minor proportion of polyisobutenes and a major proportion of polyisobutene-ethylene-diamines.

26. An additive composition according to claim 4 in which constituent (B) is a polyglycol having a polydispersity index of approximately 1 to approximately 1.25, of general formula (VII) in which each of the R groups independently represents a straight or branched alkylene group having from 2 to 4 carbon atoms and further comprising a constituent (C) selected from the group consisting of products resulting from the reaction in a first stage of at least one succinic derivative selected from alkenylsuccinic or polyalkenylsuccinic anhydrides of mean molecular mass from 100 to 3000 with at least one 1-(2-hydroxyethyl)imidazoline substituted in the 2-position selected from 1-(2-hydroxyethyl)-2-heptadecenylimidazoline and 1-(2-hydroxethyl)-2-methylimidazoline, and from the reaction in a second stage of the product from the first stage with at least one polyamine having one of the following general formulae:

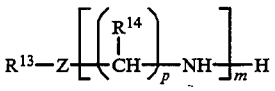

(V)

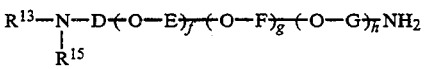

(VI)

in which Z represents an —$NR^{15}$— group, $R^{13}$, $R^{14}$ and $R^{15}$ each represent a hydrogen atom, p is equal to 2 and m is a whole number from 1 to 5, D, E, F and G, which are the same or different, each represent an alkylene group having from 2 to 4 carbon atoms, f is a whole number from 1 to 60 and g and h are equal to zero or f is a whole number from 1 to 59, h is zero or a whole number such that the sum f+h is from 1 to 59 and g is a whole number from 1 to 50 so that in each case the sum f+g+h is equal to a whole number from 1 to 60.

27. A fuel composition having a major proportion of hydrocarbons or a mixture of hydrocarbons and at least one oxygenated compound selected from the group consisting of alcohols and ethers, and a minor proportion of at least one additive composition according to claim 26.

* * * * *